US011725887B2

(12) United States Patent
Sakata

(10) Patent No.: US 11,725,887 B2
(45) Date of Patent: Aug. 15, 2023

(54) RESERVOIR TANK

(71) Applicant: TIGERS POLYMER CORPORATION, Osaka (JP)

(72) Inventor: Shunsuke Sakata, Hyogo (JP)

(73) Assignee: TIGERS POLYMER CORPORATION, Osaka (JP)

( * ) Notice: Subject to any disclaimer, the term of this patent is extended or adjusted under 35 U.S.C. 154(b) by 0 days.

(21) Appl. No.: 17/512,769

(22) Filed: Oct. 28, 2021

(65) Prior Publication Data

US 2022/0155032 A1 May 19, 2022

(30) Foreign Application Priority Data

Nov. 16, 2020 (JP) ..... 2020-189977

(51) Int. Cl.
*F28F 9/22* (2006.01)

(52) U.S. Cl.
CPC ..... *F28F 9/22* (2013.01)

(58) Field of Classification Search
CPC ..... F01P 11/029; F28F 9/22; F28D 1/05391
USPC ..... 165/157
See application file for complete search history.

(56) References Cited

U.S. PATENT DOCUMENTS 4,480,598 A * 11/1984 Berrigan ..... F01P 11/029 123/41.27
4,738,228 A * 4/1988 Jenz ..... F01P 11/029 123/41.27
5,139,082 A * 8/1992 McEachern, Jr. ..... F01P 11/028 165/104.32
6,216,646 B1 * 4/2001 Smith ..... F01P 11/029 165/104.32
6,364,213 B1 * 4/2002 Baltz ..... F01P 11/00 237/12.3 B
2002/0157621 A1 * 10/2002 Lefrancois ..... F01P 11/029 123/41.54
2006/0118067 A1 * 6/2006 Hewkin ..... F01P 11/0238 123/41.54
2008/0141955 A1 * 6/2008 Young ..... F01P 11/029 123/41.51
2010/0006577 A1 * 1/2010 Koshino ..... F01P 11/029 220/501
2011/0062163 A1 * 3/2011 Hewkin ..... F01P 11/029 220/562

FOREIGN PATENT DOCUMENTS

JP 2014-043863 A 3/2014
JP 2017101573 A * 6/2017

* cited by examiner

*Primary Examiner* — Jianying C Atkisson
*Assistant Examiner* — Raheena R Malik
(74) *Attorney, Agent, or Firm* — Pearne & Gordon LLP

(57) ABSTRACT

This reservoir tank has a tank body, an inflow pipe, a discharge pipe, and a filler port of cooling fluid in the tank body. The tank body has a first chamber and a second chamber, the filler port is provided to fill the second chamber with the cooling fluid, and an upper limit mark and a lower limit mark are displayed on the tank body. The first chamber and the second chamber communicate with each other through a lower communication path at a portion lower than the lower limit mark. Further, the upper communication path communicates a portion of the first chamber higher than the upper limit mark and a portion of the second chamber below the upper limit mark.

4 Claims, 5 Drawing Sheets

RESERVOIR TANK

CROSS-REFERENCE TO RELATED APPLICATION

This application claims priority from Japanese Patent Application No. 2020-189977 filed with the Japan Patent Office on Nov. 16, 2020, the entire contents of which is hereby incorporated by reference.

BACKGROUND

1. Technical Field

One aspect of the present disclosure relates to a reservoir tank.

2. Related Art

Liquid-cooled cooling systems are used for cooling internal combustion engines, electric elements, electronic boards, and the like. In the liquid-cooled cooling system, heat is collected from a member to be cooled by circulating cooling fluid. The heat dissipates through a heat radiator cooling the member to be cooled. In the liquid-cooled cooling system, a cooling fluid tank, that is, the reservoir tank, may be provided in a cooling fluid circuit for circulating the cooling fluid. The reservoir tank is used to compensate for a decrease in the cooling fluid due to vaporization or the like, and to absorb a volume change of the cooling fluid due to a temperature change. When air bubbles are generated in the cooling fluid, cooling efficiency may decrease. Therefore, the bubbles in the cooling fluid may be separated by the reservoir tank, that is, gas-liquid separation may be performed.

For example, in the reservoir tank disclosed in JP-A-2014-043863, an inside of a reservoir tank body is divided into a plurality of tank chambers by a partition wall. Further, the tank chambers are communicated with each other, and the cooling fluid is sequentially flowing through the tank chambers. Further, in the reservoir tank, an air hole is provided in an upper portion of the partition wall in order to guide the air bubbles and air collected in an upper portion of the tank to a pressure adjustable cap provided in a tank filler port. According to this literature, it is disclosed that even if a water level of cooling water changes, it is possible to suppress sucking of the air bubbles in the cooling water into a cooling water outlet by using the reservoir tank.

SUMMARY

A reservoir tank includes: a tank body that stores cooling fluid; an inflow pipe for feeding the cooling fluid into the tank body; a discharge pipe for discharging the cooling fluid from the tank body; and a filler port for filling the tank body with the cooling fluid, wherein the tank body has a first chamber connected to the inflow pipe and a second chamber disposed downstream of the first chamber, the filler port is provided to fill the second chamber with the cooling fluid, an upper limit mark and a lower limit mark indicating an appropriate liquid level height of the cooling fluid are displayed on the tank body, the discharge pipe is connected to the second chamber on a vertically lower side of the lower limit mark, the first chamber and the second chamber communicate with each other through a lower communication path, the lower communication path communicates a portion of the first chamber lower than the lower limit mark and a portion of the second chamber lower than the lower limit mark, the first chamber and the second chamber communicate with each other through an upper communication path, and the upper communication path communicates a portion of the first chamber higher than the upper limit mark and a portion of the second chamber below the upper limit mark.

DETAILED DESCRIPTION

Figure 1A:
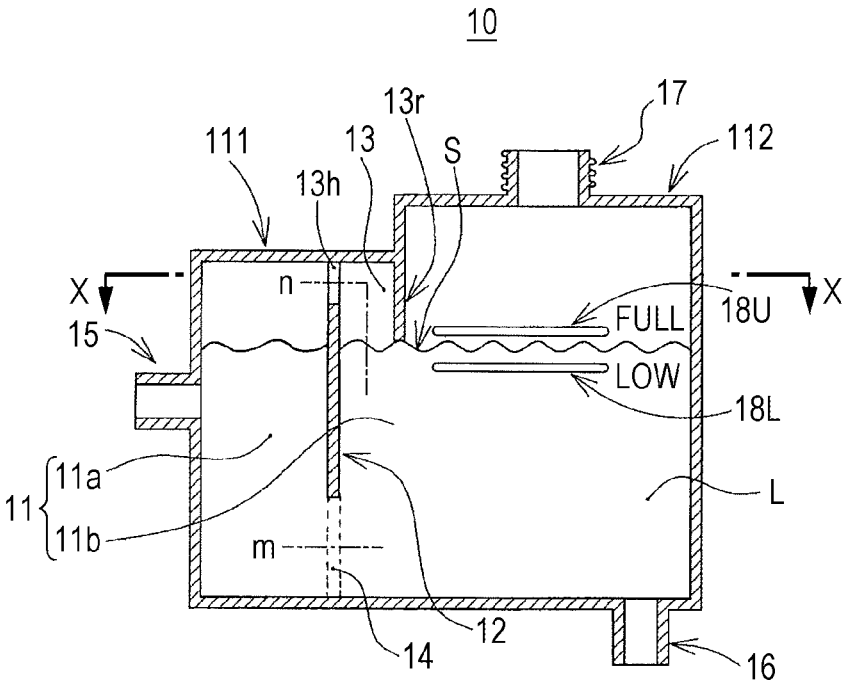
FIG. 1A is a vertical cross-sectional view illustrating a structure of a reservoir tank of a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In a reservoir tank having a plurality of tank chambers partitioned by a partition wall as described in JP-A-2014-043863, in many cases, when a liquid-cooled cooling system is assembled, cooling fluid is poured into the reservoir tank from a filler port provided in the tank, to fill the tank with the cooling fluid. At this time, due to the presence of the partition wall, air may remain in an upper portion of the tank chamber in which the filler port is not provided, and filling of the cooling fluid may be insufficient.

When an air hole is provided in an upper portion of the partition wall as in the reservoir tank described in JP-A-2014-043863, the air in an upper portion of the tank can move, so that each tank chamber can be filled with a sufficient amount of the cooling fluid.

On the other hand, in recent years, in order to improve performance of the cooling system, there has been a demand for further increasing a flow rate of the cooling fluid passing through the reservoir tank as described in JP-A-2014-043863. However, the following phenomenon has been found. That is, in the reservoir tank as described in JP-A-2014-043863, when the flow rate of the cooling fluid passing through the reservoir tank increases, the cooling fluid flowing into a tank body tends to be undulating and turbulent. Therefore, since the cooling fluid entrains the air in the tank, air bubbles are generated, and it is difficult to obtain an expected level of gas-liquid separation effect.

Specifically, in recent years, as a demand for miniaturization of the reservoir tank has increased, turbulence of the cooling fluid inside the tank body is likely to occur.

A first object of the present disclosure is to provide a reservoir tank in which each tank chamber is easily filled with a sufficient amount of the cooling fluid. In addition, a second object of the present disclosure is to suppress generation of the air bubbles inside the reservoir tank.

The inventors have studied to achieve the above object. As a result, the following facts were found. That is, if the air hole is provided in the upper portion of the partition wall as in the reservoir tank described in JP-A-2014-043863, although the first object can be achieved, it is difficult to achieve the second object. That is, when the flow rate of the cooling fluid increases, the cooling fluid flows into a downstream tank chamber from an upstream tank chamber through the air hole like a waterfall. Therefore, many air bubbles are generated in the downstream tank chamber.

The inventors further intensively studied, and as a result, found the following facts and completed a technique of the present disclosure. That is, the upstream tank chamber (a first chamber) and the downstream tank chamber (a second chamber) are communicated with each other through a communication path (an upper communication path), and the upper communication path communicates with the first chamber at a portion higher than a tank upper limit water level and communicates with the second chamber at a portion lower than the tank upper limit water level, so that both the first object and the second object can be achieved.

A reservoir tank according to a first aspect of the present disclosure includes: a tank body that stores cooling fluid; an inflow pipe for feeding the cooling fluid into the tank body from a cooling fluid circuit of a liquid-cooled cooling system; a discharge pipe for discharging the cooling fluid from the tank body to the cooling fluid circuit; and a filler port for filling the tank body with the cooling fluid, in which the tank body has a first chamber connected to the inflow pipe and a second chamber disposed downstream of the first chamber, the filler port is provided to fill the second chamber with the cooling fluid, an upper limit mark and a lower limit mark indicating an appropriate liquid level height of the cooling fluid are displayed on the tank body, the discharge pipe is connected to the second chamber on a vertically lower side of the lower limit mark, the first chamber and the second chamber communicate with each other through a lower communication path, the lower communication path communicates a portion of the first chamber lower than the lower limit mark and a portion of the second chamber lower than the lower limit mark, the first chamber and the second chamber communicate with each other through an upper communication path, and the upper communication path communicates a portion of the first chamber higher than the upper limit mark and a portion of the second chamber below the upper limit mark.

Further, a reservoir tank according to a second aspect of the present disclosure includes: a tank body that stores cooling fluid; an inflow pipe for feeding the cooling fluid into the tank body from a cooling fluid circuit of a liquid-cooled cooling system; a discharge pipe for discharging the cooling fluid from the tank body to the cooling fluid circuit; and a filler port for filling the tank body with the cooling fluid, in which the tank body has a first chamber connected to the inflow pipe, a second chamber disposed downstream of the first chamber, and a third chamber disposed downstream of the first chamber, the filler port is provided to fill the third chamber with the cooling fluid, the second chamber and the third chamber communicate with each other so that the cooling fluid and air can come and go between the second chamber and the third chamber, an upper limit mark and a lower limit mark indicating an appropriate liquid level height of the cooling fluid are displayed on the tank body, the discharge pipe is connected to the second chamber or the third chamber on a vertically lower side of the lower limit mark, the first chamber and the second chamber communicate with each other through a lower communication path, the lower communication path communicates a portion of the first chamber lower than the lower limit mark and a portion of the second chamber lower than the lower limit mark, the first chamber and the second chamber communicate with each other through an upper communication path, and the upper communication path communicates a portion of the first chamber higher than the upper limit mark and a portion of the second chamber below the upper limit mark.

In the first or second aspect, a cross-sectional area of the upper communication path is preferably smaller than that of the lower communication path (third aspect). Further, in the first or second aspect, the first chamber is preferably substantially filled with the cooling fluid by circulating the cooling fluid in the cooling fluid circuit of the liquid-cooled cooling system (fourth aspect). Furthermore, in the first aspect or second aspect, it is preferred that the first chamber and the second chamber are separated by a partition wall, and the upper communication path communicates with an upper end of the first chamber and extends in a substantially vertical direction along the partition wall (fifth aspect).

According to the reservoir tank according to the first and second aspects of the present disclosure, it is easy to fill each tank chamber with the sufficient amount of the cooling fluid, and it is possible to suppress the generation of the air bubbles inside the reservoir tank.

Further, according to the third or fourth aspect, an effect of suppressing the generation of the air bubbles is further improved. Furthermore, according to the fifth aspect, it is also possible to obtain an effect that configuration of the reservoir tank can be simplified.

Hereinafter, embodiments of the present disclosure will be described with reference to the drawings, taking the reservoir tank provided in the liquid-cooled cooling system for an internal combustion engine of an automobile as an example.

The technique of the present disclosure is not limited to individual embodiments described below, but may also be implemented as modified embodiments below. Applications of the liquid-cooled cooling system are not limited to the internal combustion engine, and may be applications for cooling an electric element such as a power element and an inverter, and an electric component such as an electronic circuit board, and further may be other applications.

Figure 1B:
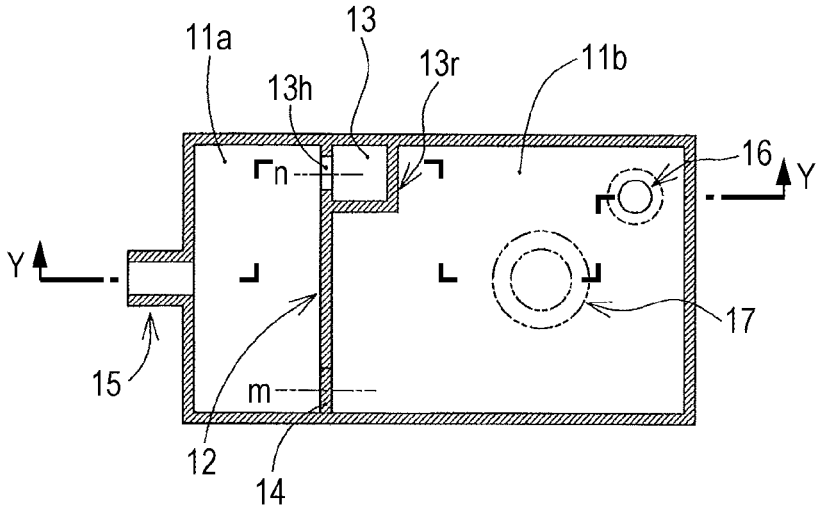
FIG. 1B is a horizontal cross-sectional view illustrating the structure of the reservoir tank.

FIGS. 1A and 1B are cross-sectional views illustrating a structure of a reservoir tank 10 of a first embodiment. FIG. 1A is a vertical cross-sectional view of the reservoir tank 10, and FIG. 1B is a horizontal cross-sectional view of the reservoir tank 10. The vertical cross-sectional view of FIG. 1A is a Y-Y cross-sectional view which is a cross-section in a vertical plane passing through a line Y-Y of FIG. 1B. In the vertical cross-sectional view of FIG. 1A, an upper side of the figure shows the vertically upper side. Further, the horizontal cross-sectional view of FIG. 1B is an X-X cross-sectional view which is a cross-section in a horizontal plane passing through a line X-X of FIG. 1A.

The reservoir tank 10 is configured to include a hollow tank body 11 and an inflow pipe 15 and a discharge pipe 16 connected to the tank body 11. When the reservoir tank 10 is used, cooling fluid L is stored in the tank body 11. Further, the air is stored in at least a part of a vertically upper portion of the tank body 11. The reservoir tank 10 used in the cooling fluid circuit of the liquid-cooled cooling system is disposed in and connected to the cooling fluid circuit of the liquid-cooled cooling system so that the cooling fluid flows into the hollow tank body 11 from the cooling fluid circuit through the inflow pipe 15, and flows out from the hollow tank body 11 to the cooling fluid circuit through the discharge pipe 16.

Although not essential, typically, the reservoir tank 10 is formed by integrating separately injection molded lower and upper cases. The hollow tank body 11 is formed by integrating the lower case and the upper case. The inflow pipe 15 and the discharge pipe 16 may be integrally molded in the lower case. Alternatively, the inflow pipe 15 and the discharge pipe 16 may be integrated with the tank body 11 by a manufacturing method different from being integrally molded with the lower case.

The reservoir tank 10 is also provided with a filler port 17. When the cooling system is assembled, the cooling fluid fills the tank body 11 through the filler port 17. When the cooling system is activated and the reservoir tank 10 is used, a cap is attached to the filler port. The cap is preferably provided with a pressure regulating valve in order to avoid an excessive pressure inside the tank body 11.

The tank body 11 has a first chamber 11*a* connected to the inflow pipe 15 and a second chamber 11*b* disposed downstream of the first chamber 11*a*. In the present embodiment, the tank body 11 is divided into the first chamber 11*a* and the second chamber 11*b* by a partition wall 12. The tank body 11 may have yet another chamber, as in another embodiment described below. In the present embodiment, the filler port 17 is provided in the upper portion of the tank body 11 so as to fill the second chamber 11*b* with the cooling fluid.

Further, on the tank body 11, an upper limit mark 18U and a lower limit mark 18L indicating an appropriate liquid level height of the cooling fluid L are displayed. The cooling fluid fills the tank body 11 so that a liquid level of the cooling fluid is between the upper limit mark 18U and the lower limit mark 18L. Although not essential, the upper limit mark 18U and the lower limit mark 18L are typically formed and displayed by embossing on an outer surface of the tank body 11. In the present embodiment, the upper limit mark 18U and the lower limit mark 18L are displayed on the outer surface of the second chamber. Specific forms of the upper limit mark 18U and the lower limit mark 18L provided on the tank body 11 are not particularly limited, and may be any form as long as it is possible to check a vertical relationship between the liquid level in the tank body 11 and these marks.

The inflow pipe 15 is connected to the first chamber 11*a*. Although not essential, from a viewpoint of suppressing air entrainment and bubbling in the first chamber 11*a*, the inflow pipe 15 is preferably connected to the first chamber 11*a* on a vertically lower side of the lower limit mark 18L. Further, although not essential, from the same viewpoint, the inflow pipe 15 is preferably provided so that a flow of the cooling fluid flowing from the inflow pipe 15 into the first chamber 11*a* hits the partition wall 12 substantially vertically.

The discharge pipe 16 is connected to the second chamber 11*b* on the vertically lower side of the lower limit mark 18L. With such a configuration, the cooling fluid containing less air bubbles and air is easily discharged from the discharge pipe 16. The discharge pipe 16 is preferably connected to the vicinity of a lower surface of the second chamber 11*b*.

The first chamber 11*a* and the second chamber 11*b* communicate with each other through an upper communication path 13 and a lower communication path 14. The upper communication path 13 is provided vertically above the lower communication path 14.

The first chamber 11*a* and the second chamber 11*b* communicate with each other through the lower communication path 14. The lower communication path 14 communicates the first chamber 11*a* with the second chamber 11*b* at a position submerged in the cooling fluid in the reservoir tank 10. That is, the lower communication path 14 communicates the first chamber with the second chamber at a portion lower than the lower limit mark 18L. That is, the lower communication path 14 communicates a portion of the first chamber 11*a* lower than the lower limit mark 18L with a portion of the second chamber 11*b* lower than the lower limit mark 18L. A route (indicated by a center line m) of the lower communication path may extend in a substantially horizontal direction or may be inclined. In the present embodiment, the lower communication path 14 is provided in a form of a through-hole provided in the partition wall 12 near a bottom surface of the first chamber 11*a* and the second chamber 11*b*.

The first chamber 11*a* and the second chamber 11*b* are also communicated with each other through the upper communication path 13. In FIGS. 1A and 1B, a route of the upper communication path 13 is indicated by a center line n. The upper communication path 13 communicates a portion of the first chamber 11*a* higher than the upper limit mark 18U and a portion of the second chamber 11*b* below the upper limit mark 18U. That is, the upper communication path 13 communicates portions of the first chamber 11*a* and the second chamber 11*b* distanced from each other in a height direction. A portion communicating with the first chamber 11*a* of the upper communication path 13 is located at a vertically higher position than a portion communicating with the second chamber 11*b* of the upper communication path 13.

Although not essential, in the present embodiment, the first chamber 11*a* and the second chamber 11*b* are separated by the partition wall 12 extending in the substantially vertical direction, and the upper communication path 13 communicates with the upper end of the first chamber 11*a*, and extends in the substantially vertical direction along the partition wall 12. That is, a through-hole 13*h* is provided in the partition wall 12 near the upper end of the first chamber 11*a*. Further, on a side of the second chamber 11*b*, a rib 13*r* is provided to extend in the substantially vertical direction so as to surround the through-hole 13*h*. The rib 13*r* is connected to a wall surface and a top surface of the tank body 11, and the partition wall 12. The rib 13*r*, the wall surface of the tank body 11, and the partition wall 12 form a pipe line extending in the substantially vertical direction. The pipe line and the through-hole 13*h* form the upper communication path 13. The through-hole 13*h* is provided at a position higher than the upper limit mark 18U. A lower end of the pipe line formed by the rib 13*r* is open in the portion below the upper limit mark 18U of the second chamber 11*b*.

Although not essential, the upper communication path 13 preferably communicates with near the upper end of the first chamber 11*a*, on a side of the first chamber 11*a*. Further, although not essential, the upper communication path 13 preferably communicates with a portion lower than the lower limit mark 18L of the second chamber 11*b*, on the side of the second chamber 11*b*. Note that the upper communication path 13 may communicate with the second chamber 11*b* at substantially the same height as the upper limit mark 18U, on the side of the second chamber 11*b*. In this case, if a vertical height difference between the upper limit mark 18U and the second chamber side opening of the upper communication path 13 is smaller than 5 mm, preferably 3 mm, they can be regarded as having substantially the same height, and it can be said that the second chamber 11*b* side of the upper communication path 13 is open to the portion below the upper limit mark 18U.

The cross-sectional area of the upper communication path 13 is preferably smaller than that of the lower communication path 14. The cross-sectional area of the communication path does not need to be constant over a length direction of the communication path. When a part of the communication path is narrowed down, the cross-sectional area of a narrowed portion may be regarded as the cross-sectional area of the communication path. The cross-sectional area of the upper communication path 13 is preferably ⅕ or less, and more preferably 1/10 or less of the cross-sectional area of the lower communication path 14.

Although not essential, the first chamber 11*a* is preferably substantially filled with the cooling fluid by circulating the cooling fluid through the cooling fluid circuit of the liquid-cooled cooling system as in the reservoir tank 10 of the present embodiment. When the cooling system is activated and the cooling fluid circulates, the liquid level in the first chamber 11*a* rises when the cooling fluid flows into the first chamber 11*a*. Due to this rise in the liquid level, the air remaining in an upper portion of the first chamber 11*a* is discharged to the second chamber 11*b* through the upper communication path 13. Thus, the first chamber 11*a* is substantially filled with the cooling fluid. By adjusting the cross-sectional area of the lower communication path 14 depending on a given flow rate of the cooling fluid, and/or adjusting a size and/or a height of the first chamber 11*a*, particularly the height of a top surface 111 of the first chamber 11*a*, it can be realized that the first chamber 11*a* is substantially filled with the cooling fluid. Although not essential, as in the present embodiment, the height of the top surface 111 of the first chamber 11*a* is preferably lower than that of a top surface 112 of the second chamber 11*b* so that a height difference between the top surface 111 of the first chamber 11*a* and the upper limit mark 18U is small.

As far as the tank body 11, the first chamber 11*a*, the second chamber 11*b*, the partition wall 12, the inflow pipe 15, the discharge pipe 16, the upper communication path 13, the lower communication path 14, the filler port 17, and the like of the reservoir tank 10 can be formed, what kind of members the above-mentioned structure of the reservoir tank 10 is specifically divided into to make the reservoir tank (how to make the reservoir tank 10 as an aggregate of constituent members (parts)) is not particularly limited. For example, the above-mentioned structure of the reservoir tank 10 may be made by dividing the reservoir tank 10 into two of the lower case and the upper case, which are integrally molded together with the partition wall and the like, and by assembling them. Alternatively, such a structure may be made by another member configuration. For example, the above-mentioned structure of the reservoir tank 10 may be made by forming constituent members such that the tank body 11 is divided into two by a vertical plane and by assembling them.

In the first embodiment, a material forming the reservoir tank 10 and a method for manufacturing the reservoir tank 10 are not particularly limited. The reservoir tank 10 can be manufactured by a known material and a known manufacturing method. Typically, the reservoir tank 10 is formed using a thermoplastic resin such as a polyamide resin as a main material. The material, reinforcing structure, and the like of the reservoir tank 10 are determined depending on the type, temperature, pressure, and the like of the cooling fluid to be used. Typically, the reservoir tank 10 can be manufactured by respectively forming members corresponding to the lower case and the upper case by injection molding, and by integrating the members by vibration welding, hot plate welding or the like. In that case, the inflow pipe 15, the discharge pipe 16, the filler port 17, and the partition wall 12 are preferably integrally molded with the lower case or the upper case. Alternatively, the inflow pipe 15, the discharge pipe 16, the filler port 17, and the partition wall 12 may be formed as separate members and integrated into the lower case or the upper case by later assembly.

Operations and effects of the reservoir tank 10 of the first embodiment will be described. In the reservoir tank 10 of the first embodiment, each tank chamber is easily filled with the sufficient amount of the cooling fluid. Further, it is possible to suppress the generation of the air bubbles inside the reservoir tank 10.

Figure 6:
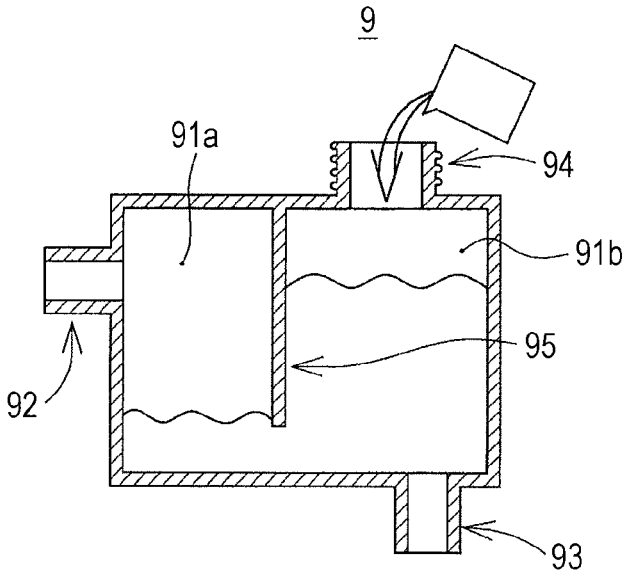
FIG. 6 is a vertical cross-sectional view illustrating the operation of the reservoir tank of Reference Example 1.

First, it will be described that each tank chamber is easily filled with the sufficient amount of the cooling fluid. FIG. 6 illustrates as Reference Example 1 an operation of a reservoir tank 9 when the cooling fluid fills the reservoir tank 9 having no upper communication path. The reservoir tank 9 according to Reference Example 1 illustrated in FIG. 6 has the same configuration as the reservoir tank 10 of the first embodiment except that there is no upper communication path. When the cooling fluid from a filler port 94 is filling the reservoir tank 9 of Reference Example 1, a second chamber 91*b* can be filled with the sufficient amount of the cooling fluid, but a first chamber 91*a* is difficult to be sufficiently filled with the cooling fluid. That is, in the reservoir tank 9, the first chamber 91*a* is separated from the filler port 94 by a partition wall 95. Therefore, even if the cooling fluid tries to flow into the first chamber 91*a* from the lower communication path, the air accumulated in the upper portion of the first chamber 91*a* prevents inflow of the cooling fluid. As a result, it is difficult to sufficiently fill the first chamber 91*a* with the cooling fluid.

Figure 2:
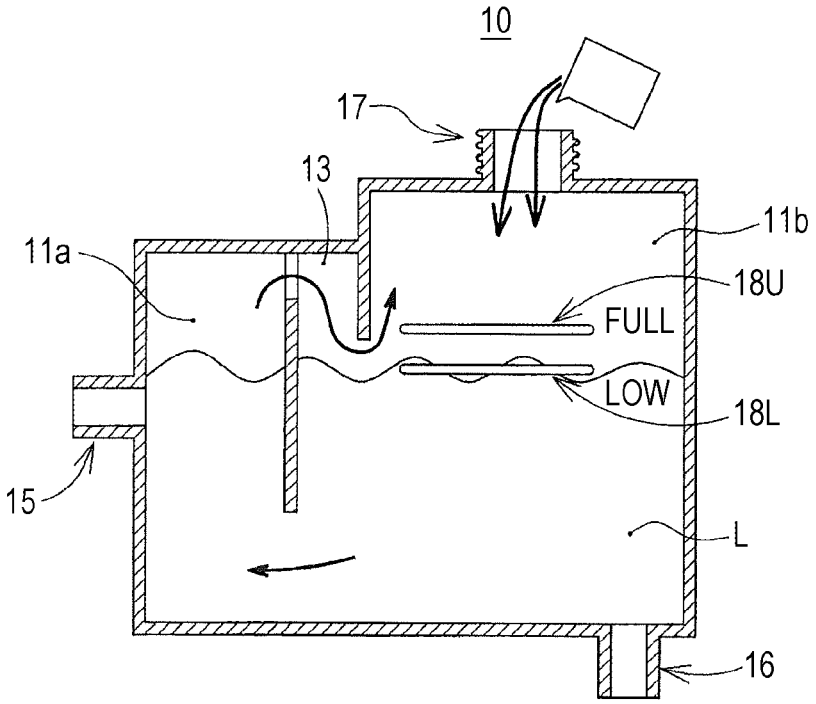
FIG. 2 is a vertical cross-sectional view illustrating an operation of the reservoir tank of the first embodiment at the time of filling with water.

On the other hand, in the reservoir tank 10 of the first embodiment, the first chamber 11*a* and the second chamber 11*b* communicate with each other through the upper communication path 13. In addition, the upper communication path 13 communicates a portion of the first chamber 11*a* higher than the upper limit mark 18U and a portion of the second chamber 11*b* below the upper limit mark 18U (that is, a portion having the same height as the upper limit mark, or a portion lower than the upper limit mark). With this configuration, as illustrated in FIG. 2, when the cooling water is filling the reservoir tank 10, until an opening of the upper communication path 13 on the second chamber 11*b* side is completely submerged by the liquid level of the cooling fluid in the second chamber 11*b*, the upper communication path 13 substantially serves as an air vent path, and releases the air in the upper portion of the first chamber 11*a* to the second chamber 11*b*.

Therefore, in the reservoir tank 10 of the first embodiment, the first chamber 11*a* can also be filled with the cooling fluid to a height close to the upper limit mark 18U and the lower limit mark 18L. Therefore, each tank chamber is filled with the sufficient amount of the cooling fluid. Note that when the cooling fluid from the filler port 17 is filling the reservoir tank 10, from a viewpoint of filling the first chamber 11*a* with more cooling fluid, the upper communication path 13 preferably communicate with the second chamber 11*b* at a position closer to the upper limit mark 18U on the side of the second chamber 11*b*.

Figure 7:
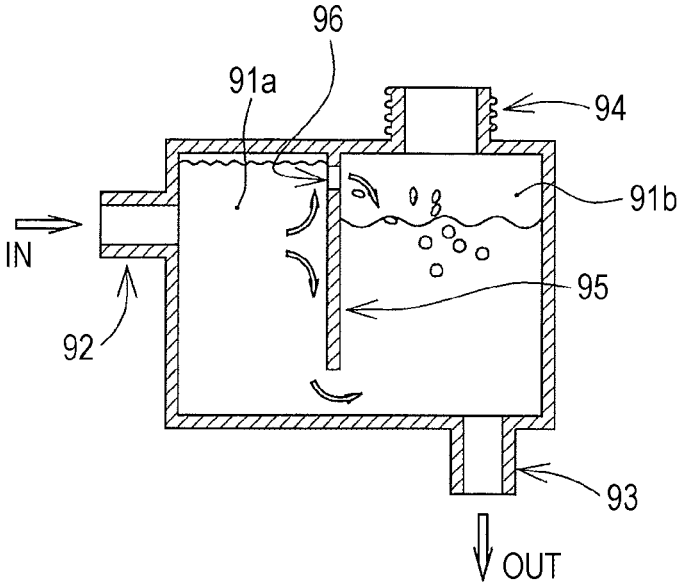
FIG. 7 is a vertical cross-sectional view illustrating the operation of the reservoir tank of Reference Example 2.

Next, an action of suppressing the generation of the air bubbles inside the reservoir tank 10 will be described. FIG. 7 illustrates as Reference Example 2 the operation of the reservoir tank 99 when the cooling fluid circulates in the reservoir tank 99 provided with a known air hole 96 in the partition wall 95. Reference Example 2 illustrated in FIG. 7 has the same configuration as the reservoir tank 10 of the first embodiment except that the upper portion of the first chamber 91*a* and an upper portion of the second chamber 91*b* communicate with each other through a simple air hole (through-hole) 96. In FIG. 7, the flow of the cooling fluid is indicated by a white arrow.

In the reservoir tank 99 of Reference Example 2, the cooling fluid flows from an inflow pipe 92 into the first chamber 91*a*, and is discharged from a discharge pipe 93 through the second chamber 91*b*. At this time, the cooling fluid flowing from the inflow pipe 92 stays in the first chamber 91*a*, so that a water level in the first chamber rises. Therefore, the cooling fluid flows from the first chamber 91*a* to the second chamber 91*b* not only from the lower communication path but also from the air hole 96. Then, the cooling fluid released from the air hole 96 into the second chamber 91*b* flows down like a waterfall toward the liquid surface of the cooling fluid stored in the second chamber 91*b*. Therefore, in the reservoir tank 99 of Reference Example 2, the air is entrained in the cooling fluid in the second chamber 91*b*, so that the air bubbles are generated.

Figure 3:
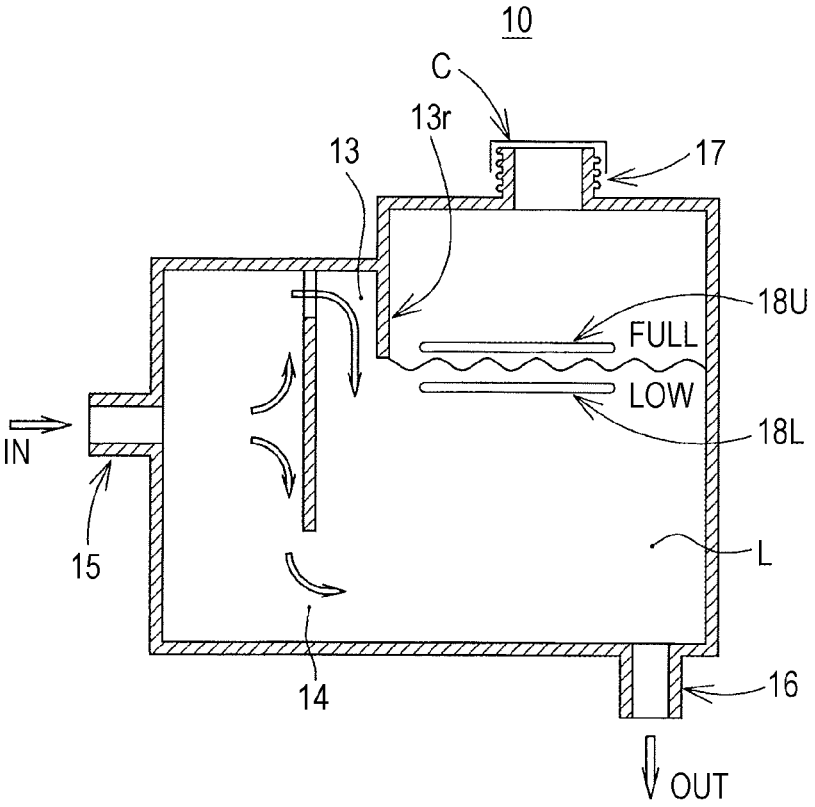
FIG. 3 is a vertical cross-sectional view illustrating the operation of the reservoir tank of the first embodiment during use.

On the other hand, in the reservoir tank 10 of the first embodiment, since the upper communication path 13 has the configuration described above, the generation of the air bubbles is suppressed as illustrated in FIG. 3. Since the cooling fluid flowing from the inflow pipe 15 stays in the first chamber 11*a*, the water level in the first chamber 11*a* rises, and the cooling fluid flows from the first chamber 11*a* to the second chamber 11*b* not only from the lower communication path 14 but also from the upper communication path 13, which is the same as in Reference Example 2. In the reservoir tank 10 of the first embodiment, the upper communication path 13 communicates with the portion of the second chamber 11*b* below the upper limit mark 18U. Therefore, the cooling fluid flowing from the upper communication path 13 into the second chamber 11*b* flows substantially directly into the cooling fluid stored in the second chamber 11*b*, so that the air in the reservoir tank 10 is hardly entrained in the cooling fluid. Thus, the generation of the air bubbles in the second chamber 11*b* is suppressed.

From the viewpoint of suppressing the generation of the air bubbles in the reservoir tank 10, the upper communication path 13 is preferably opened to the second chamber 11*b* side at a lower position. Although not essential, it is particularly preferred that the second chamber side opening of the upper communication path 13 communicates with the portion of the second chamber 11*b* that is lower than the lower limit mark 18L. In this case, the flow from the upper communication path 13 is better released into the cooling fluid in the second chamber 11*b*. Therefore, the air entrainment and the generation of the air bubbles can be better suppressed.

Further, when the cross-sectional area of the upper communication path 13 is smaller than that of the lower communication path 14, the amount of the cooling fluid passing through the upper communication path 13 is reduced. Therefore, the generation of the air bubbles in the second chamber 11*b* can be suppressed more effectively.

Further, when the first chamber 11*a* and the second chamber 11*b* are separated by the partition wall 12, and the upper communication path 13 communicates with the upper end of the first chamber 11*a*, and extends in the substantially vertical direction along the partition wall 12, the cooling fluid stored in the second chamber 11*b* is hardly turbulent by the flow from the upper communication path 13. Therefore, the generation of the air bubbles in the second chamber 11*b* can be suppressed more effectively. In addition, such an upper communication path 13 is advantageous in suppressing remaining of the air in the first chamber, and can be efficiently manufactured.

From the viewpoint of suppressing the generation of the air bubbles in the reservoir tank 10, the first chamber 11*a* is preferably substantially filled with the cooling fluid by circulating the cooling fluid in the cooling fluid circuit of the liquid-cooled cooling system. The flow of the cooling fluid from the inflow pipe 15 directly flows into the first chamber 11*a*. Therefore, the cooling fluid tends to flow violently and complicatedly inside the first chamber 11*a*. However, if the first chamber 11*a* is substantially filled with the cooling fluid, it is possible to suppress the entrainment of the air in the cooling fluid and the generation of the air bubbles inside the first chamber 11*a*.

In the reservoir tank 10 of the above embodiment, when the cooling fluid flows into the first chamber 11*a*, by utilizing a phenomenon that the liquid level of the cooling fluid in the first chamber 11*a* rises, the air inside the first chamber 11*a* can be discharged to the second chamber 11*b* side through the upper communication path 13. From the viewpoint of suppressing the remaining of the air in the first chamber 11*a*, the first chamber side opening of the upper communication path 13 preferably communicates with near the upper end of the first chamber 11*a*. In addition, from the viewpoint of suppressing the remaining of the air in the first chamber 11*a*, the height of the top surface 111 of the first chamber 11*a* is preferably set lower than that of the top surface 112 of the second chamber 11*b*. Thus, it is possible to suppress the remaining of the air in the first chamber 11*a* while storing an appropriate amount of air in the second chamber 11*b*.

Further, when the opening on the second chamber 11*b* side of the upper communication path 13 is provided in a portion below the lower limit mark 18L, the air is discharged from inside the first chamber 11*a* by the flow of the cooling fluid, and a state in which the first chamber 11*a* is substantially filled with the cooling fluid is maintained even after the flow of the cooling fluid is stopped. Further, even if the flow of the cooling fluid is restarted, the generation of the air bubbles in the first chamber 11*a* is suppressed. Therefore, the generation of the air bubbles can be suppressed particularly effectively.

The aspects of the present disclosure are not limited to the above embodiment, but can be implemented with various modifications. Hereinafter, other embodiments of the present disclosure will be described. In the following description, portions different from the above embodiment will be mainly described, and the same portions will be denoted by the same reference numerals and detailed description thereof will be omitted. Further, the embodiments can be implemented by combining some of them or replacing some of them.

Figure 4A:
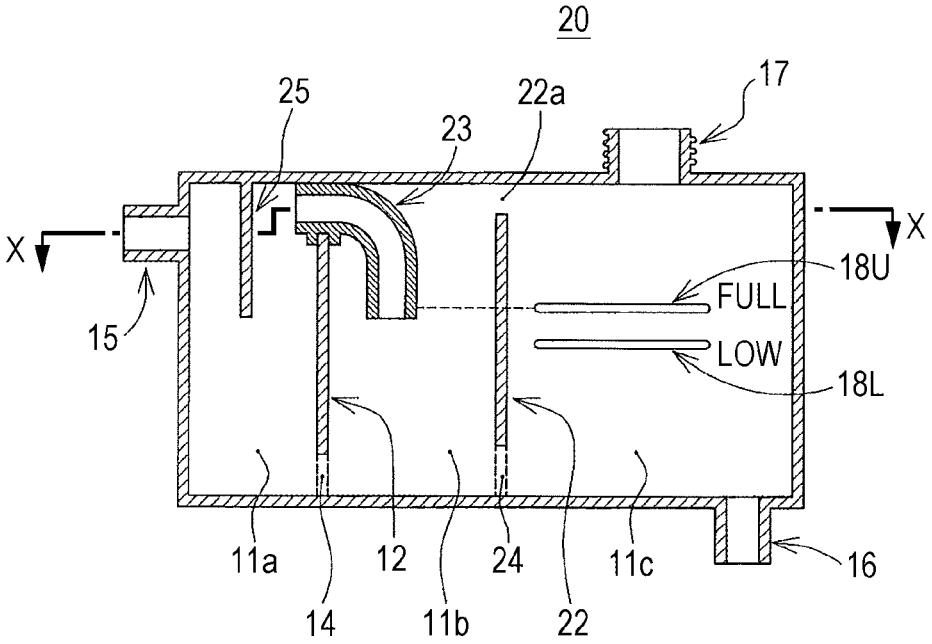
FIG. 4A is a vertical cross-sectional view illustrating the structure of the reservoir tank of a second embodiment.
Figure 4B:
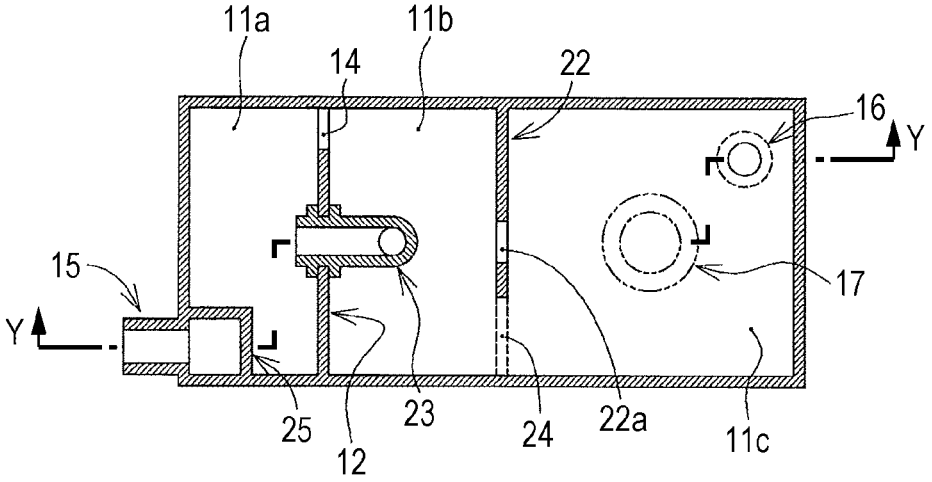
FIG. 4B is a horizontal cross-sectional view illustrating the structure of the reservoir tank.

FIGS. 4A and 4B illustrates a structure of a reservoir tank 20 of a second embodiment. FIGS. 4A and 4B are vertical and horizontal cross-sectional views corresponding to FIGS. 1A and 1B in the first embodiment. The reservoir tank 20 of the second embodiment is different from the reservoir tank 10 of the first embodiment in configuration of the inflow pipe, configuration of an upper communication path 23, and including a third chamber 11*c*. Other configurations of the reservoir tank 20 of the second embodiment is generally the same as that of the reservoir tank 10 of the first embodiment.

The tank body of the reservoir tank 20 further has a third chamber 11*c* disposed downstream of the first chamber 11*a* in addition to the first chamber 11*a* and the second chamber 11*b*. The third chamber 11*c* is only required to be disposed downstream of the first chamber 11*a*, and does not necessarily have to be disposed downstream of the second chamber 11*b*. The second chamber 11*b* and the third chamber 11*c* are partitioned by a partition wall 22.

In the reservoir tank 20 of the present embodiment, the filler port 17 is provided so as to fill the third chamber 11*c* with the cooling fluid. Further, the second chamber 11*b* and the third chamber 11*c* communicate with each other so that the cooling fluid and the air can come and go between them freely. In the present embodiment, an air hole 22*a* is provided to communicate the second chamber 11*b* and the third chamber 11*c* in an upper portion of the reservoir tank 20. Further, a communication path 24 that communicates the second chamber 11*b* and the third chamber 11*c* is provided. The communication path 24 is submerged in the cooling fluid in a lower portion of the reservoir tank 20. A slit-like communication path extending in the vertical direction to serve as the air hole 22*a* and as the communication path 24 may be provided between the second chamber 11*b* and the third chamber 11*c*.

Due to the action of the air hole 22*a* and the communication path 24, the water level of the cooling fluid in the second chamber 11*b* and the third chamber 11*c* is substantially equal to each other when the cooling fluid fills the reservoir tank 20 and when the cooling system is not operating. Therefore, the upper limit mark 18U and the lower limit mark 18L may be provided in either the second chamber 11*b* or the third chamber 11*c* in the tank body.

Further, in the present embodiment, the discharge pipe 16 is connected to the third chamber 11*c* on the vertically lower side of the lower limit mark 18L. The discharge pipe 16 may be connected to the second chamber 11*b*. Note that when the discharge pipe 16 is connected to the third chamber 11*c* located downstream of the second chamber 11*b*, the liquid level of the second chamber 11*b* can be raised by momentum of the cooling fluid flowing into the second chamber 11*b*. Therefore, it is possible to satisfactorily realize that through the second chamber side opening submerged in the cooling fluid, the upper communication path 23 communicates with the second chamber 11*b*. Therefore, the generation of the air bubbles in the second chamber 11*b* can be better suppressed.

As described above, even when the tank body of the reservoir tank 20 has the third chamber 11*c*, if a specific upper communication path 23 is provided between the first chamber 11*a* and the second chamber 11*b*, each tank chamber is easily filled with the sufficient amount of the cooling fluid, and the generation of the air bubbles inside the reservoir tank 20 can be suppressed as in the reservoir tank 10 of the first embodiment.

Further, in the reservoir tank 20 of the present embodiment, specific configuration of the upper communication path 23 provided between the first chamber 11*a* and the second chamber 11*b* is different from that of the above-mentioned reservoir tank 10. In the reservoir tank 20, the upper communication path 23 is formed by attaching a rubber communication path member formed in a bent tubular shape to the through-hole provided in the upper portion of the partition wall 12. Even such a configuration, the upper communication path 23 has the same action as the upper communication path 13 of the reservoir tank 10 described above. Further, when the upper communication path 23 has such a configuration, even a reservoir tank having a complicated internal structure can be efficiently manufactured.

Further, in the reservoir tank 20 of the present embodiment, a pipe line is formed by a rib 25 so that the inflow pipe 15 is substantially extended to an inside of the first chamber 11*a*. In order to suppress that the cooling fluid flowing from the inflow pipe 15 flows directly into the upper communication path 23 (pipe line of the communication path member) or the lower communication path 14, it is preferred that arrangement and orientation of the inflow pipe 15 is adjusted, and the cooling fluid flowing from the inflow pipe 15 is introduced into the first chamber 11*a* through the pipe line of the rib 25. When the pipe line such as the rib 25 that extends the inflow pipe 15 is provided, from the viewpoint of suppressing the generation of the air bubbles inside the reservoir tank 20, the pipe line for extension is preferably provided to extend in the substantially vertical direction.

Further, like the reservoir tank 20 of the present embodiment, when viewed in a plan view (FIG. 4B), it is preferred that the partition walls 12 and 22, the lower communication path 14, and the communication path 24 are arranged so that the flow of the cooling fluid from the inflow pipe 15 to the discharge pipe 16 greatly meanders in an S shape. Similarly, like the reservoir tank 10 of the first embodiment, when viewed in a plan view, it is preferred that the partition wall 12 and the lower communication path 14 are arranged so that the flow of the cooling fluid from the inflow pipe 15 to the discharge pipe 16 through the lower communication path 14 is greatly bent in a U shape.

Figure 5:
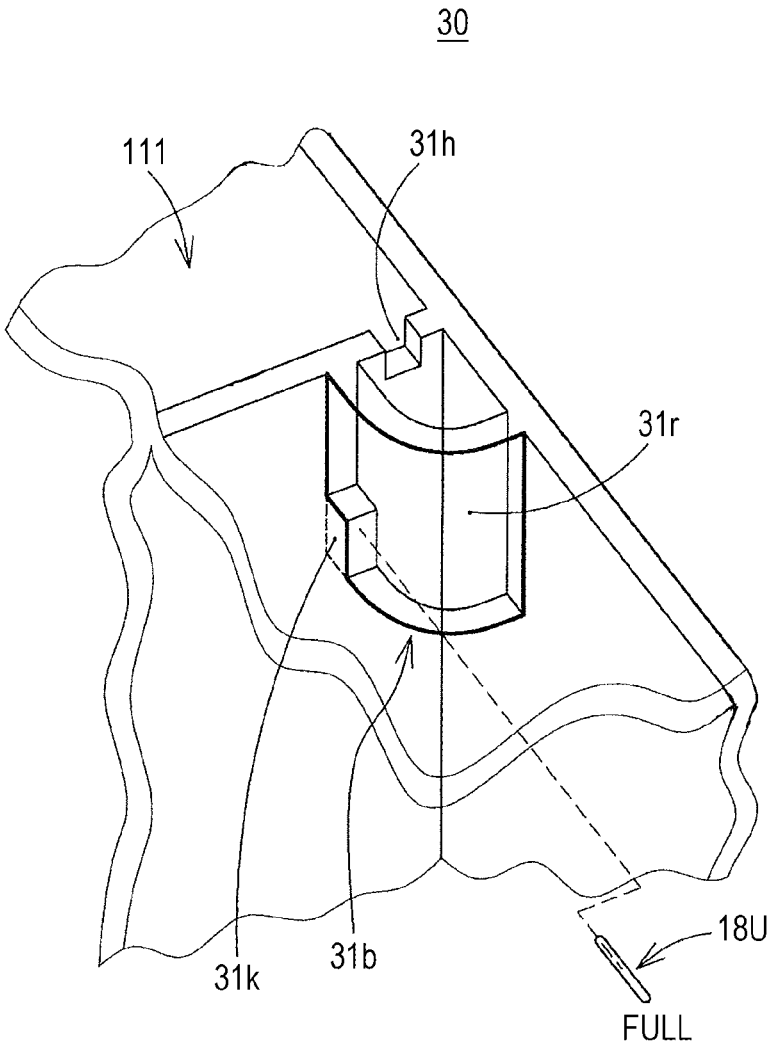
FIG. 5 is a perspective view illustrating a structure around an upper communication path of the reservoir tank of a third embodiment.

FIG. 5 illustrates a reservoir tank 30 of a third embodiment. FIG. 5 is a perspective view of the vicinity of the upper communication path as viewed from obliquely above on the side of the second chamber. In FIG. 5, a far side of the partition wall 12 is the first chamber, and a near side thereof is the second chamber. The reservoir tank 30 of the third embodiment is different from the reservoir tank 10 of the first embodiment in a specific shape of the upper communication path.

The upper communication path of the reservoir tank 30 of the third embodiment is formed near the upper end of the first chamber by a through-hole 31*h* provided in the partition wall 12 and a pipe line formed by the partition wall 12, the wall surface of the reservoir tank 30 and a rib 31*r*. In this respect, the upper communication path of the reservoir tank 30 is the same as the upper communication path 13 in the first embodiment. Further, the rib 31*r* may be a rib having a cylindrical surface as in the present embodiment.

As in the present embodiment, a cutout 31*k* may be provided at the portion, where the upper communication path communicates with the second chamber. That is, in the portion, at which the upper communication path communicates with the second chamber, through the cutout 31*k* in the rib 31*r*, the upper communication path communicates with the second chamber at a vertically higher position. A portion of the rib 31*r* other than the cutout 31*k* extends to a vertically lower end (edge) 31*b*. The cutout 31*k* is preferably provided at a position adjacent to the partition wall 12.

The cutout 31*k* functions as an air escape route when the cooling fluid fills the reservoir tank 30. By setting an upper edge of the cutout 31*k* to the same height as the upper limit mark 18U, the first chamber can also be filled with the cooling fluid to the upper limit level.

Further, in the present embodiment, when the cooling system is activated and the cooling fluid circulates, the cooling fluid flowing from the first chamber to the second chamber through the through-hole 31*h* flows along an uncut portion (a portion facing the through-hole 31*h* and the partition wall 12) of the rib 31*r*, passes through the lower end 31*b* of the rib, and flows into the cooling fluid stored in the second chamber. Therefore, by setting the lower end 31*b* of the rib vertically lower than the liquid level of the cooling fluid stored in the second chamber, it is possible to better suppress that the cooling fluid flowing into the second chamber from the upper communication path entrains the air, and generates the air bubbles. From this point of view, in the present embodiment, the lower end 31*b* of the rib is particularly preferably formed lower than the lower limit mark 18L.

As described above, by providing the cutout at the portion, where the upper communication path communicates with the second chamber, it is possible to achieve at a higher level both performances of sufficient filling of the cooling fluid in each tank chamber and suppression of the generation of the air bubbles in the second chamber.

In the reservoir tanks 10, 20, and 30 of the embodiments described above, the tank body 11 has a rectangular parallelepiped shape. In this regard, a shape of the tank bodies of the reservoir tanks 10, 20 and 30 is not limited to the rectangular parallelepiped shape. For example, the tank body may be spherical. The shape of the tank body is not particularly limited, and may be another shape such as a cylindrical shape, an elliptical cylinder shape, and an ellipsoidal shape.

Further, in the description of the above embodiment, the first chamber and the second chamber are partitioned by the partition wall. In this regard, it is not essential that the two chambers be separated by the partition wall. For example, in the reservoir tank, it may be configured such that the first chamber and the second chamber are provided independently in the tank body, and a tubular upper and/or lower communication path is provided between the first chamber and the second chamber.

Further, the reservoir tank may have yet another tank chamber. Further, the tank chamber of the reservoir tank, particularly the second and subsequent tank chambers may have a gas-liquid separation structure. The gas-liquid separation structure may be a structure in which the air bubbles are separated while the cooling fluid flows in a labyrinth-like manner in the tank chambers, or a structure in which gas-liquid separation is performed using centrifugal force. Examples of the latter structure include a structure in which gas-liquid separation is performed by creating a vortex inside the tank chamber.

In the above embodiments, the tank body is provided with the inflow pipe 15 and discharge pipe 16 one each. In this regard, a plurality of inflow pipes and discharge pipes may be provided depending on configuration of the cooling system. Even when the inflow pipes and the discharge pipes are provided, not all the inflow pipes and the discharge pipes need to have the configuration as in the above embodiments. It is sufficient that some of the inflow pipes and the discharge pipes have the configuration as in the above embodiments.

The reservoir tank according to the embodiment of the present disclosure may have still another configuration. For example, the tank body may be provided with a pressure release valve. Further, a stay, a boss member, or the like for attaching the reservoir tank to a vehicle body or the like may be integrated with the reservoir tank as necessary. Furthermore, the reservoir tank may be provided with a reinforcing structure such as a rib depending on a pressure resistance or the like required for the reservoir tank.

The reservoir tank according to the embodiments of the present disclosure can be used in the cooling fluid circuit of the cooling system. The reservoir tank according to the embodiments of the present disclosure can suppress the generation of the air bubbles in the cooling fluid, and thus has a high industrial utility value.

Further, the reservoir tank according to the embodiments of the present disclosure may be the following first and second reservoir tanks.

The first reservoir tank is a reservoir tank provided in the cooling fluid circuit of the liquid-cooled cooling system, and includes: a tank body that stores cooling fluid; an inflow pipe for feeding the cooling fluid into the tank body from a cooling fluid circuit of a liquid-cooled cooling system; a discharge pipe for discharging the cooling fluid from the tank body to the cooling fluid circuit; and a filler port for filling the tank body with the cooling fluid, and the tank body has a first chamber connected to the inflow pipe and a second chamber disposed downstream of the first chamber, the filler port is provided to fill the second chamber with the cooling fluid, an upper limit mark and a lower limit mark indicating an appropriate liquid level height of the cooling fluid are displayed on the tank body, the discharge pipe is connected to the second chamber on a vertically lower side of the lower limit mark, the first chamber and the second chamber communicate with each other through a lower communication path, the lower communication path communicates the first chamber and the second chamber at a portion lower than the lower limit mark, the first chamber and the second chamber communicate with each other through an upper communication path, and the upper communication path communicates a portion of the first chamber higher than the upper limit mark and a portion of the second chamber below the upper limit mark.

The second reservoir tank is a reservoir tank provided in the cooling fluid circuit of the liquid-cooled cooling system, and includes: a tank body that stores cooling fluid; an inflow pipe for feeding the cooling fluid into the tank body from a cooling fluid circuit of a liquid-cooled cooling system; a discharge pipe for discharging the cooling fluid from the tank body to the cooling fluid circuit; and a filler port for filling the tank body with the cooling fluid, and the tank body has a first chamber connected to the inflow pipe, a second chamber disposed downstream of the first chamber, and a third chamber disposed downstream of the first chamber, the filler port is provided to fill the third chamber with the cooling fluid, the second chamber and the third chamber communicate with each other so that the cooling fluid and air can come and go between each other, an upper limit mark and a lower limit mark indicating an appropriate liquid level height of the cooling fluid are displayed on the tank body, the discharge pipe is connected to the second chamber or the third chamber on a vertically lower side of the lower limit mark, the first chamber and the second chamber communicate with each other through a lower communication path, the lower communication path communicates the first chamber and the second chamber at a portion lower than the lower limit mark, the first chamber and the second chamber communicate with each other through an upper communication path, and the upper communication path communicates a portion of the first chamber higher than the upper limit mark and a portion of the second chamber below the upper limit mark.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A reservoir tank comprising:

a tank body that stores cooling fluid;

an inflow pipe for feeding the cooling fluid into the tank body;

a discharge pipe for discharging the cooling fluid from the tank body; and a filler port for filling the tank body with the cooling fluid, wherein the tank body has a first chamber connected to the inflow pipe and a second chamber disposed downstream of the first chamber, the filler port is provided to fill the second chamber with the cooling fluid, an upper limit mark and a lower limit mark indicating an appropriate liquid level height of the cooling fluid are displayed on the tank body, the discharge pipe is connected to the second chamber on a vertically lower side of the lower limit mark, the first chamber and the second chamber communicate with each other through a lower communication path, the lower communication path communicates a portion of the first chamber lower than the lower limit mark and a portion of the second chamber lower than the lower limit mark, the first chamber and the second chamber communicate with each other through an upper communication path, the upper communication path communicates a portion of the first chamber higher than the upper limit mark and a portion of the second chamber below the upper limit mark, the upper communication path is defined by a tubular pipe line having openings, the openings consist of a first opening located at one end of the pipe line and a second opening located at another end of the pipe line, the first opening faces the first chamber at a position higher than the upper limit mark, the second opening faces the second chamber at a position below the upper limit mark, and the reservoir tank further comprises a rib in the second chamber, the rib extending from a top inner surface of the second chamber to the position below the upper limit mark and above the lower limit mark so as to divide the tubular pipe line from the second chamber; the rib, the top inner surface of the second chamber and a partition wall dividing the first chamber and the second chamber define the tubular pipe line.

2. A reservoir tank comprising:

a tank body that stores cooling fluid;

an inflow pipe for feeding the cooling fluid into the tank body;

a discharge pipe for discharging the cooling fluid from the tank body; and a filler port for filling the tank body with the cooling fluid, wherein the tank body has a first chamber connected to the inflow pipe, a second chamber disposed downstream of the first chamber, and a third chamber disposed downstream of the first chamber, the filler port is provided to fill the third chamber with the cooling fluid, the second chamber and the third chamber communicate with each other so that the cooling fluid and air can come and go between the second chamber and the third chamber, an upper limit mark and a lower limit mark indicating an appropriate liquid level height of the cooling fluid are displayed on the tank body, the discharge pipe is connected to the second chamber or the third chamber on a vertically lower side of the lower limit mark, the first chamber and the second chamber communicate with each other through a lower communication path, the lower communication path communicates a portion of the first chamber lower than the lower limit mark and a portion of the second chamber lower than the lower limit mark, the first chamber and the second chamber communicate with each other through an upper communication path, the upper communication path communicates a portion of the first chamber higher than the upper limit mark and a portion of the second chamber below the upper limit mark, the upper communication path is defined by a tubular pipe line having openings, the openings consist of a first opening located at one end of the pipe line and a second opening located at another end of the pipe line, the first opening faces the first chamber at a position higher than the upper limit mark, the second opening faces the second chamber at a position below the upper limit mark, and the reservoir tank further comprises a rib in the second chamber, the rib extending from a top inner surface of the second chamber to the position below the upper limit mark and above the lower limit mark so as to divide the tubular pipe line from the second chamber; the rib, the top inner surface of the second chamber and a partition wall dividing the first chamber and the second chamber define the tubular pipe line.

3. A reservoir tank comprising:

a tank body that stores cooling fluid;

an inflow pipe for feeding the cooling fluid into the tank body;

a discharge pipe for discharging the cooling fluid from the tank body; and a filler port for filling the tank body with the cooling fluid, wherein the tank body has a first chamber connected to the inflow pipe and a second chamber disposed downstream of the first chamber, the filler port is provided to fill the second chamber with the cooling fluid, an upper limit mark and a lower limit mark indicating an appropriate liquid level height of the cooling fluid are displayed on the tank body, the discharge pipe is connected to the second chamber on a vertically lower side of the lower limit mark, the first chamber and the second chamber communicate with each other through a lower communication path, the lower communication path communicates a portion of the first chamber lower than the lower limit mark and a portion of the second chamber lower than the lower limit mark, the first chamber and the second chamber communicate with each other through an upper communication path, the upper communication path communicates a portion of the first chamber higher than the upper limit mark and a portion of the second chamber below the upper limit mark, the upper communication path is defined by a tubular pipe line having openings, the openings consist of a first opening located at one end of the pipe line and a second opening located at another end of the pipe line, the first opening faces the first chamber at a position higher than the upper limit mark, the second opening faces the second chamber at a position below the upper limit mark, and the tubular pipe line comprises a rib extending from a top inner surface of the second chamber to the position below the upper limit mark and above the lower limit mark, the rib divides the tubular pipe line from the second chamber; the rib, the top inner surface of the second chamber and a partition wall dividing the first chamber and the second chamber define the tubular pipe line.

4. A reservoir tank comprising:

a tank body that stores cooling fluid;

an inflow pipe for feeding the cooling fluid into the tank body;

a discharge pipe for discharging the cooling fluid from the tank body; and a filler port for filling the tank body with the cooling fluid, wherein the tank body has a first chamber connected to the inflow pipe, a second chamber disposed downstream of the first chamber, and a third chamber disposed downstream of the first chamber, the filler port is provided to fill the third chamber with the cooling fluid, the second chamber and the third chamber communicate with each other so that the cooling fluid and air can come and go between the second chamber and the third chamber, an upper limit mark and a lower limit mark indicating an appropriate liquid level height of the cooling fluid are displayed on the tank body, the discharge pipe is connected to the second chamber or the third chamber on a vertically lower side of the lower limit mark, the first chamber and the second chamber communicate with each other through a lower communication path, the lower communication path communicates a portion of the first chamber lower than the lower limit mark and a portion of the second chamber lower than the lower limit mark, the first chamber and the second chamber communicate with each other through an upper communication path, the upper communication path communicates a portion of the first chamber higher than the upper limit mark and a portion of the second chamber below the upper limit mark, the upper communication path is defined by a tubular pipe line having openings, the openings consist of a first opening located at one end of the pipe line and a second opening located at another end of the pipe line, the first opening faces the first chamber at a position higher than the upper limit mark, the second opening faces the second chamber at a position below the upper limit mark, and the tubular pipe line comprises a rib extending from a top inner surface of the second chamber to the position below the upper limit mark and above the lower limit mark so as to divide the tubular pipe line from the second chamber; the rib, the top inner surface of the second chamber and a partition wall dividing the first chamber and the second chamber define the tubular pipe line.

* * * * *